US007708528B2

(12) United States Patent
Couch et al.

(10) Patent No.: US 7,708,528 B2
(45) Date of Patent: May 4, 2010

(54) PLATFORM MATE FACE CONTOURS FOR TURBINE AIRFOILS

(75) Inventors: Eric Couch, South Windsor, CT (US); Frank J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 701 days.

(21) Appl. No.: 11/220,291

(22) Filed: Sep. 6, 2005

(65) Prior Publication Data

US 2009/0304516 A1 Dec. 10, 2009

(51) Int. Cl.
*F01D 5/30* (2006.01)

(52) U.S. Cl. ..... 416/193 A

(58) Field of Classification Search ..... 416/193 A, 416/248, 189, 190, 191, 193 R
See application file for complete search history.

(56) References Cited

U.S. PATENT DOCUMENTS 4,878,811 A * 11/1989 Jorgensen ..... 416/215

6,558,121 B2 * 5/2003 Zhu et al. ..... 416/193 A

OTHER PUBLICATIONS

Drawing of prior art "chevron" platform blade.

* cited by examiner

*Primary Examiner*—Edward Look
*Assistant Examiner*—Dwayne J White
(74) *Attorney, Agent, or Firm*—Carlson, Gaskey & Olds

(57) ABSTRACT

Gas turbine engine components having an airfoil extending outwardly of a platform are mounted in adjacent relationship, and such that cooling air flows outwardly of a gap between mating faces of the platforms. The location of localized hot spots is identified on the platform, and the mating faces are designed to provide cooling air through the gap to address these hot spots. A suction side edge of the platform has a curved portion extending inwardly into the platform, and the pressure side has a curved portion bulging outwardly away from the airfoil. When these two portions on adjacent components mate, a gap is provided between two platforms that provides leakage cooling air to the hot spot.

9 Claims, 1 Drawing Sheet

PLATFORM MATE FACE CONTOURS FOR TURBINE AIRFOILS

This invention was made with government support under Contract No. F33615-03-D-235-0006 awarded by the United States Air Force. The government therefore has certain lights in this invention.

BACKGROUND OF THE INVENTION

This application relates to an improved airfoil, wherein mate faces between adjacent airfoils are contoured to optimize cooling air flow between the mate faces.

Various components in a gas turbine engine have an airfoil shape extending outwardly from a platform. One example is a turbine blade, which typically includes a platform, with an airfoil extending above the platform. The airfoil is curved, extending from a leading edge to a trailing edge, and between a pressure wall and a suction wall.

The turbine blade can become quite hot during operation of the gas turbine engine. Thus, cooling circuits are formed within the turbine blade to circulate cooling fluid, typically air. A number of cooling channels extend through the cross-section of the airfoil, and from the platform outwardly toward a tip. Air passes through these channels, and cools the turbine blade.

Many distinct types of cooling circuits are provided within the airfoil, and associated structures such as a platform, the root, etc. As known, a number of turbine blades are mounted to be circumferentially spaced. Leakage air is allowed to flow between a leading face of the platform, a trailing face of the platform, and on mate faces between adjacent platforms. This air cools the platforms, and allows the airfoils to better survive in the harsh environment of the gas turbine engine.

The platform has side edges that define mate faces. The cooling air flow between the mate faces has been directed by the gap between the mate faces. The gap is parallel to the mate faces, and the mate faces have traditionally been parallel to a groove within the root such that the blade can be more easily mounted to a rotor.

Applicant has determined that, for various reasons, providing cooling air flow from a gap between generally straight edges of a platform, does not optimize this cooling air flow. Instead, applicant has recognized that there are hot spots on the platform due to several features that are not best addressed by the prior cooling air flow.

In at least one prior art airfoil, the platform side edges are defined by a pair of straight sections. This was to allow the use of a platform having an edge extending on an angle that might otherwise intersect with the airfoil. This has not been utilized to address local hot spots.

SUMMARY OF THE INVENTION

In a disclosed method of this invention, an airfoil is studied, and heat stresses along the platform are identified. Localized hot spots are identified adjacent the approximate area of the mate faces. The mate faces are then designed to assure optimum cooling air flow from the gap between the mate faces over these hot spots. The present invention thus results in a platform for turbine airfoil components, which has better cooling characteristics due to the optimized direction of the cooling air between the mate faces. In addition, and flowing from the above-described benefit, internal cooling channels may be eliminated as not being necessary. Thus, the present invention not only improves operation, but may also reduce the complexity of manufacturing the turbine blade.

In a disclosed embodiment of this invention, the mate face has a curved portion near the hot spot, and then a second straight portion.

These and other features of the present invention can be best understood from the following specification and drawings, the following of which is a brief description.

DETAILED DESCRIPTION OF THE PREFERRED EMBODIMENT

Figure 1:
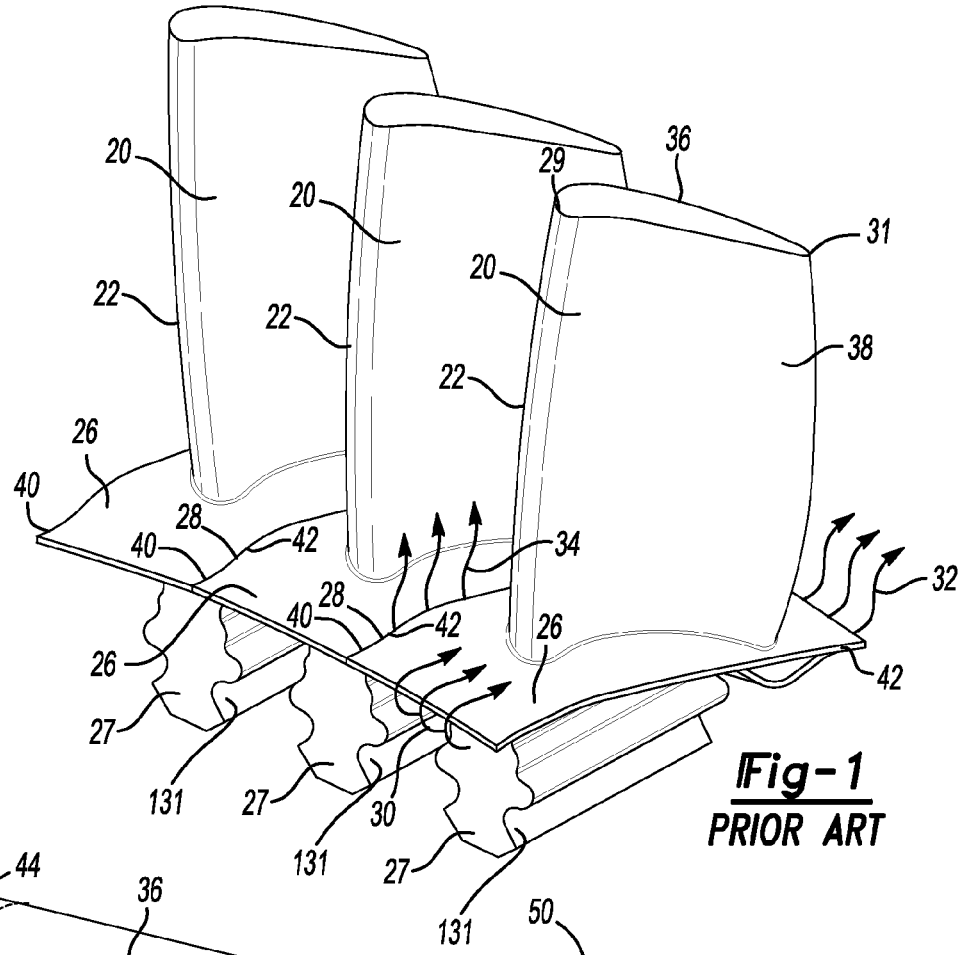
Fig-1 PRIOR ART
FIG. 1 shows a plurality of prior art gas turbine engine turbine blades.

Prior art turbine blades 20 are illustrated in FIG. 1, having airfoils 22, and platforms 26. As is known, a root portion 27 is utilized to mount the turbine blade 20 within a rotor.

The roots 27 have grooves 31 for being received in a mating structure on the rotor. Gaps 28 are formed between mating faces 40 and 42 on adjacent turbine blades. The airfoils 22 each have a leading edge 29 and a trailing edge 131. Air flow leaks around the platform 26 at the leading edge as shown at 30, and at the trailing edge as shown at 32. Further, air flow leaks at 34 between a gap 28 between the mating faces 40 and 42. These air flows assist in cooling the turbine blade 20, and in particular along the platforms 26. As known, the airfoils have a pressure wall 38 and a suction wall 36.

In the prior art illustrated in FIG. 1, the mate faces 40 and 42 are defined by edges of the platform 26 that extend generally parallel to the grooves 31 in root 27.

Figure 2:
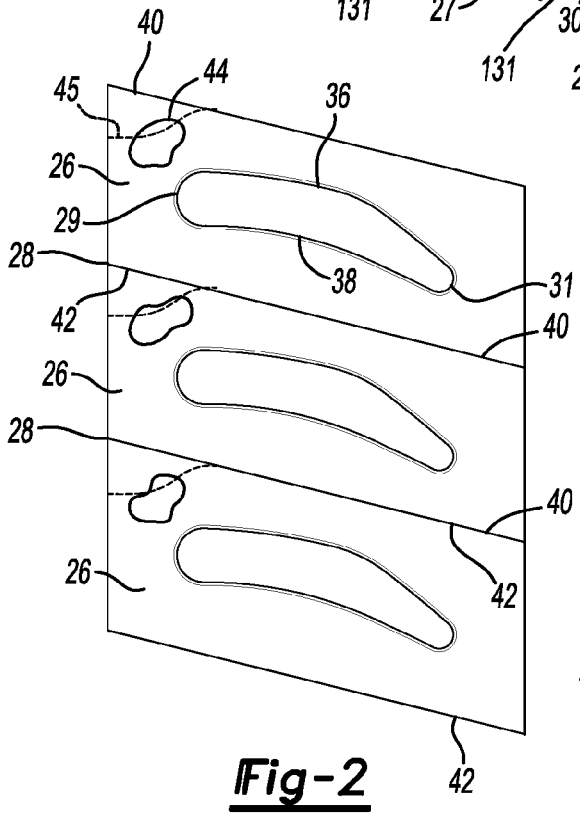
Fig-2 PRIOR ART
FIG. 2 is a top view of the prior art blades.

As shown in FIG. 2, the edges 40 and 42 on platforms 26 extend generally parallel to each other, and along a generally straight line.

Heat stress analysis shows hot spots 44 on the platforms 26. The air flow from the gaps 28 flows along the platform, and as controlled by the movement of the turbine blades, etc. The air flow paths or streamlines can be mapped and studied. However, this air flow has never been controlled or designed to flow in a particular direction based upon the location of the hot spot 44. Applicant has now considered the heat stress and air flow streamlines, and has identified an improved mate face to direct cooling air to the platform. As shown in FIG. 2, a path 45 extends along a curve, and is an optimum location of the air flow 34 for addressing the hot spot 44. As mentioned, the design of the airfoil platform has never taken this path 45 into account. That is, path 45 is not part of the prior art.

Figure 3:
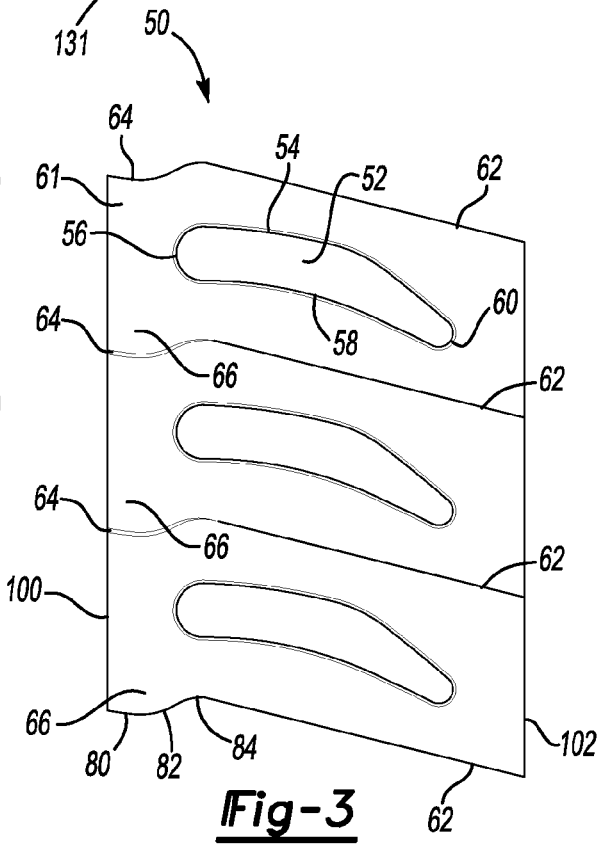
FIG. 3 is a top view of an inventive blade made according to an inventive method.

FIG. 3 shows an inventive gas turbine blade 50, wherein the airfoil 52 has a suction wall 54, a leading edge 56, a pressure wall 58 and a trailing edge 60. One edge of the platform 61 has a straight portion 62 leading to a curved indent 64. The opposed side of the platform 61 has a similar straight section 62 leading to a bulged section 66. The sections 64 and 66 are formed along curves that may be optimally modeled on the path 45. When the blades 50 are mounted within a gas turbine environment, air flow leaks between the gaps between turbine blades 50. The air flow from the gap between sections 64 and 66 is directed to best address the local hot spots 44. As is clear, the curved sections 64 and bulged sections 66 are spaced away from the trailing edge 60 relative to the straight portions 62.

As can be appreciated in FIG. 3, the contours of the sections 64 or 66 generally can be said to have a leading edge section 80, an intermediate section 82, and a merging section 84, which merges with the relatively straight portions 62. The sections 80 and 84 extend along curves, but have a major component in their direction that is parallel to the path of the relatively straight sections 62. The intermediate section 82 extends along a curve that has a larger component perpendicular to the direction of the relatively straight section 62. It has been found that this general contour provides the best cooling air flow paths to address the hot spots 44, at least in a number of turbine blade designs.

Further, while the term "relatively straight portions" has been utilized to define portion 62, it should be understood that the part does extend along contours and curves in several directions, and thus, the surface may not be identically straight.

As can be appreciated from FIG. 3, the straight portions 62 are non-perpendicular to the leading edge face 100 and trailing edge 102 of the platform.

The present invention thus improves upon the prior art.

While the present invention is specifically disclosed in a turbine blade, it has application in the design of any gas turbine engine components having airfoils and platforms wherein the components are mounted to be adjacent to each other and cooling air flow is provided between the mating faces. As an example, static vanes would benefit from this invention, as would other components that meet this basic definition.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine component for use in a turbine section, comprising:

an airfoil for use in a turbine section of a gas turbine engine, and extending outwardly of a platform, said platform having a pressure side and a suction side, and said platform having a relatively straight portion on said suction side beginning from a trailing edge of said platform and extending towards a leading edge, and an inwardly curved portion extending into said platform, and in a direction toward said airfoil from said relatively straight portion, and said pressure side of said platform having a relatively straight portion extending from said trailing edge toward said leading edge, and an outwardly curved portion bulging outwardly from said relatively straight portion and away from said airfoil, such that said outwardly curved portion of said pressure side can mate with said inwardly curved portion of said suction side of an adjacent platform, said outwardly curved portion and said inwardly curved portion being spaced away from said trailing edge relative to their respective straight portions;

said relatively straight portions of said suction and pressure sides extending generally parallel to each other; and said generally parallel relatively straight portions extending from a trailing edge end of the platform, and said trailing edge end of the platform being non-perpendicular to said relatively straight portions.

2. The gas turbine engine component as set forth in claim 1, wherein said curved portions are designed to provide air flow to a location to best address an identified hot spot.

3. The gas turbine engine component as set forth in claim 1, wherein said gas turbine engine component is a turbine blade.

4. The gas turbine engine component as set forth in claim 1, wherein said inwardly and outwardly curved portions each have a contour with a first portion adjacent said leading edge that extends along a direction having a major component parallel to said relatively straight portions, said contour having an intermediate portion that is curved, and extends along a direction which is more perpendicular to said relatively straight portions than said leading edge portion, and a merging portion merging from said intermediate portion into said relatively straight portions, said merging portions also extending along a direction having a major component parallel to said relatively straight portions.

5. The turbine section as set forth in claim 1, wherein said inwardly and outwardly curved portions each have a contour with a first portion adjacent said leading edge that extends along a direction having a major component parallel to said relatively straight portions, said contour having an intermediate portion that is curved, and extends along a direction which is more perpendicular to said relatively straight portions than said leading edge portion, and a merging portion merging from said intermediate portion into said relatively straight portions, said merging portions also extending along a direction having a major component parallel to said relatively straight portions.

6. A turbine section for a gas turbine engine comprising:

a turbine section including a plurality of adjacent components each having an airfoil extending upwardly away from a platform, and with platforms on adjacent ones of said gas turbine engine components having mating surfaces in closely spaced proximity to each other, with a gap between said mating surfaces to allow air flow to pass through said gap and along said platforms, said platforms having a pressure side and a suction side, and said platform having a relatively straight portion on said suction side beginning from a trailing edge of said platform and extending towards a leading edge, and an inwardly curved portion extending into said platform, and in a direction toward said airfoil from said relatively straight portion, and said pressure side of said platform having a relatively straight portion extending from said trailing edge toward said leading edge, and an outwardly curved portion bulging outwardly from said relatively straight portion and away from said airfoil, such that said outwardly curved portion of said pressure side mates with said inwardly curved portion of said suction side of an adjacent platform, said outwardly curved portion and said inwardly curved portion being spaced away from said trailing edge relative to their respective straight portions, said generally parallel relatively straight portions extend from a trailing edge end of the platform, and said trailing edge of the platform being non-perpendicular to said relatively straight portions.

7. The turbine section as set forth in claim 6, wherein said relatively straight portions of said suction and pressure sides extend generally parallel to each other.

8. The turbine section as set forth in claim 6, wherein said curved portions are designed to provide air flow to a location to best address an identified hot spot.

9. The turbine section as set forth in claim 6, wherein said gas turbine engine components are turbine blades.

* * * * *